US006964247B1

(12) United States Patent
Lin

(10) Patent No.: US 6,964,247 B1
(45) Date of Patent: Nov. 15, 2005

(54) EXCREMENT CONTAINER

(76) Inventor: Hsun-Chin Lin, 4F., No.332, Songjiang Rd., Taipei City 104 (TW)

( * ) Notice: Subject to any disclaimer, the term of this patent is extended or adjusted under 35 U.S.C. 154(b) by 0 days.

(21) Appl. No.: 10/892,252

(22) Filed: Jul. 16, 2004

(51) Int. Cl.[7] ..... A01K 23/00; A01K 29/00
(52) U.S. Cl. ..... 119/867; 294/1.3
(58) Field of Search ..... 119/867, 161; 294/1.3–1.5

(56) References Cited

U.S. PATENT DOCUMENTS

| | | | | |
|---|---|---|---|---|
| 4,017,015 A | * | 4/1977 | Jefferson | 294/1.3 |
| 4,200,319 A | * | 4/1980 | Cooper | 294/1.4 |
| 4,243,259 A | * | 1/1981 | Wright | 294/1.3 |
| 4,349,104 A | * | 9/1982 | Hayes | 206/205 |
| 4,865,371 A | * | 9/1989 | Egberg | 294/1.3 |
| 4,917,238 A | * | 4/1990 | Schumacher | 206/223 |
| 5,441,017 A | * | 8/1995 | Lindsay | 119/795 |
| 6,398,278 B1 | * | 6/2002 | Orr | 294/1.4 |

FOREIGN PATENT DOCUMENTS

| | | | | |
|---|---|---|---|---|
| GB | 2242822 A | * | 10/1991 | A01K 29/00 |
| JP | 09294497 A | * | 11/1997 | A01K 23/00 |
| JP | 104815 | * | 10/1998 | A01K 23/00 |
| TW | 370773 | | 9/1999 | |
| TW | 499839 | | 8/2002 | |

* cited by examiner

*Primary Examiner*—Son T. Nguyen

(57) ABSTRACT

An excrement includes a hollow box body having an opening for covering a cover body thereon. The box body and the cover body are connected to a hanging body. A first inner cup and a second inner cup are contained in the box body. The second inner cup is inserted and disposed into the first inner cup. Each inner cup is in a box shape, which can be flattened into a thin flat sheet. The storage space required for the inner cups is thus reduced. In addition, the accessibility and the portability of the inner cups are also enhanced. Therefore, whenever bringing a pet outdoors, one can easily clean up the excrement of the pet by employing the excrement container of the present invention.

17 Claims, 7 Drawing Sheets

EXCREMENT CONTAINER

BACKGROUND OF THE INVENTION

The present invention relates generally to an excrement container, and more particularly to an excrement container for containing excrement of a pet. The container can be flattened into a thin flat sheet, so as to reduce the storage space and to enhance the accessibility and portability.

Since people in the modern society are more and more busy and mutually segregated, there has been developed a trend of keeping a pet as their companion. However, the excrement of the pet often generates malodorous smell. Without a proper care being taken, the living environment is easily polluted and contagious diseases are easily spread and mediated. It is accordingly an incentive for the inventor of the present invention to develop an excrement container that is easy and convenient in use.

The applicant of the present invention has developed a "multipurpose excrement container", which is published in a Taiwanese new utility model patent no. 370773 (application no.: 87218911). The multipurpose excrement container includes a box body, a cover member and a hanging member. An opening is formed at one end of the box body. The opening provides the cover member to connect thereon. A barrel element is formed at the inner side of the cover member. The barrel element can be contained in the box body. In addition, a holding element is formed at the outer side of the cover member. The hanging member is properly connected to the outer wall of the box body. Since the barrel element of the cover member is employed to contain excrement of a pet, one needs to clean and wash the inside of the barrel element after the excrement is thrown away, which is rather quite unsanitary.

In accordance with the above drawbacks, an improved multipurpose excrement container has been developed and published in Taiwanese new utility model patent no. 499839 (application number: 87218911). The barrel element of the cover member described above is separated from the cover member, and designed as a combination of a first inner cup and a second inner cup. The inner cups are made of disposable materials that can be thrown away with the excrement without further washing and cleaning.

However, the first inner cup and the second inner cup are cylindrical in shape. In order to maximize its volume, the inner cups are usually made to fit the size of the box body. On the other hand, since the inner cups can not be flattened into thin flat sheets, they often occupy quite a large space in storage and are very inconvenient for bringing outdoors. In addition, when the inner cups are employed to clean up the excrement, one need to press down the opening of the inner cup for obtaining a wider surface contact with the ground, thereby successfullly draw the excrement into the inner cup. However, in the pressing down process, the opening is easily deformed into irregular shape. Therefore, the deformed inner cup is difficult to be covered up with the corresponding inner cup.

Accordingly, the inventor of the present invention has devoted himself based on his many years of practical experiences to the development of a new excrement container that can resolve the problem discussed above.

BRIEF SUMMARY OF THE INVENTION

The present invention is to provide an excrement container including a first inner cup and a second cup that both can be flattened into thin flat sheets, so as to reduce the storage space required and to enhance the accessibility and portability thereof.

The present invention is also to provide an excrement container including disposable inner cups that can be thrown away with the excrement without the need of cleaning and washing, so as to prevent pet owners from contacting the excrement and being infected of contagious diseases.

The present invention is still to provide an excrement container including inner cups that are in box shape. The inner cup includes a broad and smooth opening rim that can act as a dustpan for cleaning up the excrement.

In order to achieve the above and other objectives, the present invention provides an excrement container including a hollow box body having an opening for covering a cover body on the box body. The box body is connected to a hanging body. A first inner cup and a second inner cup are contained in the box body. The second inner cup is inserted and disposed into the first inner cup. Each inner cup is in a box shape, which can be flattened into a thin flat sheet. The objectives set forth above can thus be achieved.

DETAILED DESCRIPTION OF THE INVENTION

In order to better understanding the features and technical contents of the present invention, the present invention is hereinafter described in detail by incorporating with the accompanied drawings. However, the accompanied drawings are only for the convenience of illustration and description, no limitation is intended thereto.

Figure 1:
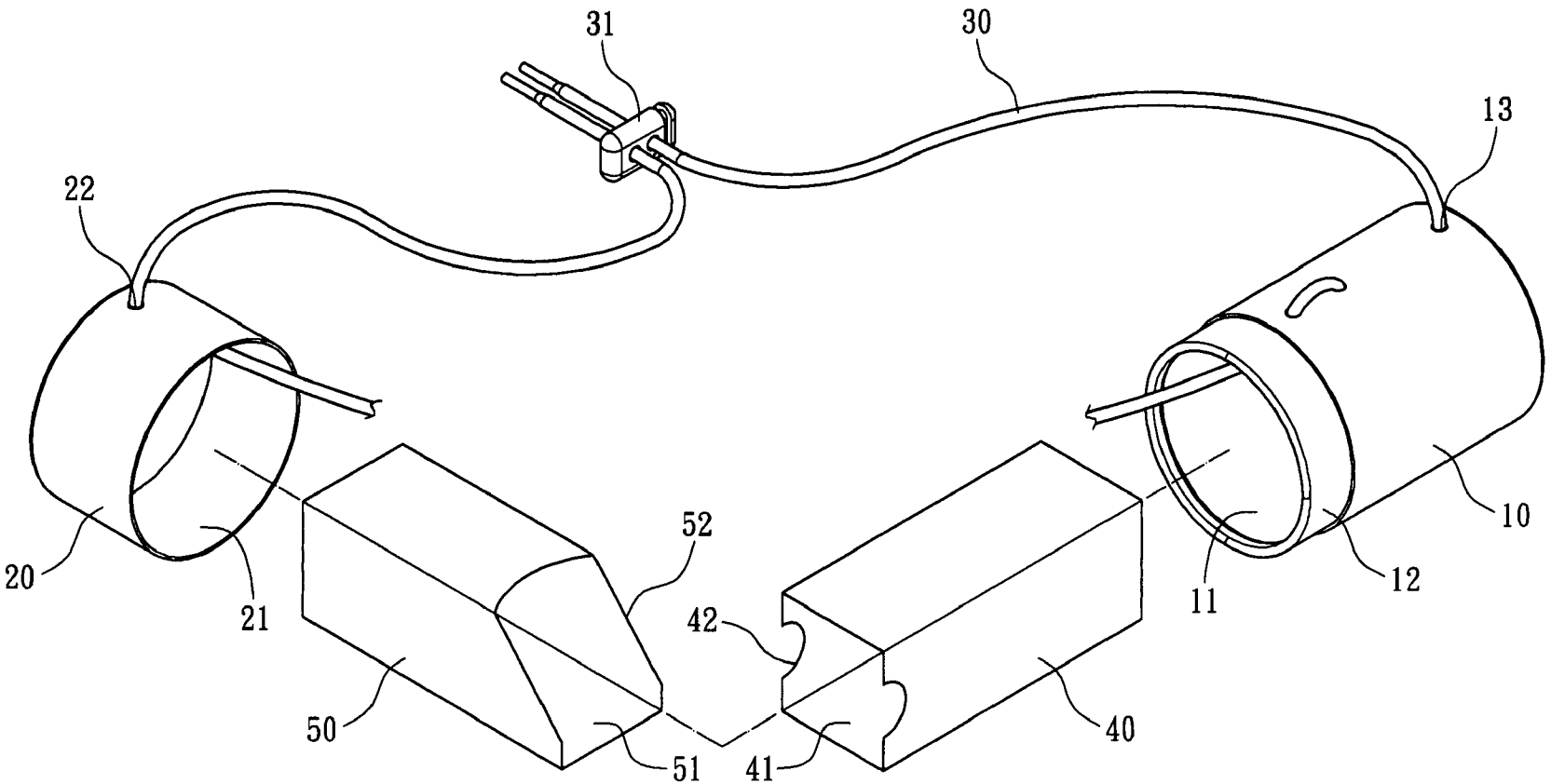
FIG. 1 is an explosive view of an excrement container of the present invention.
Figure 2:
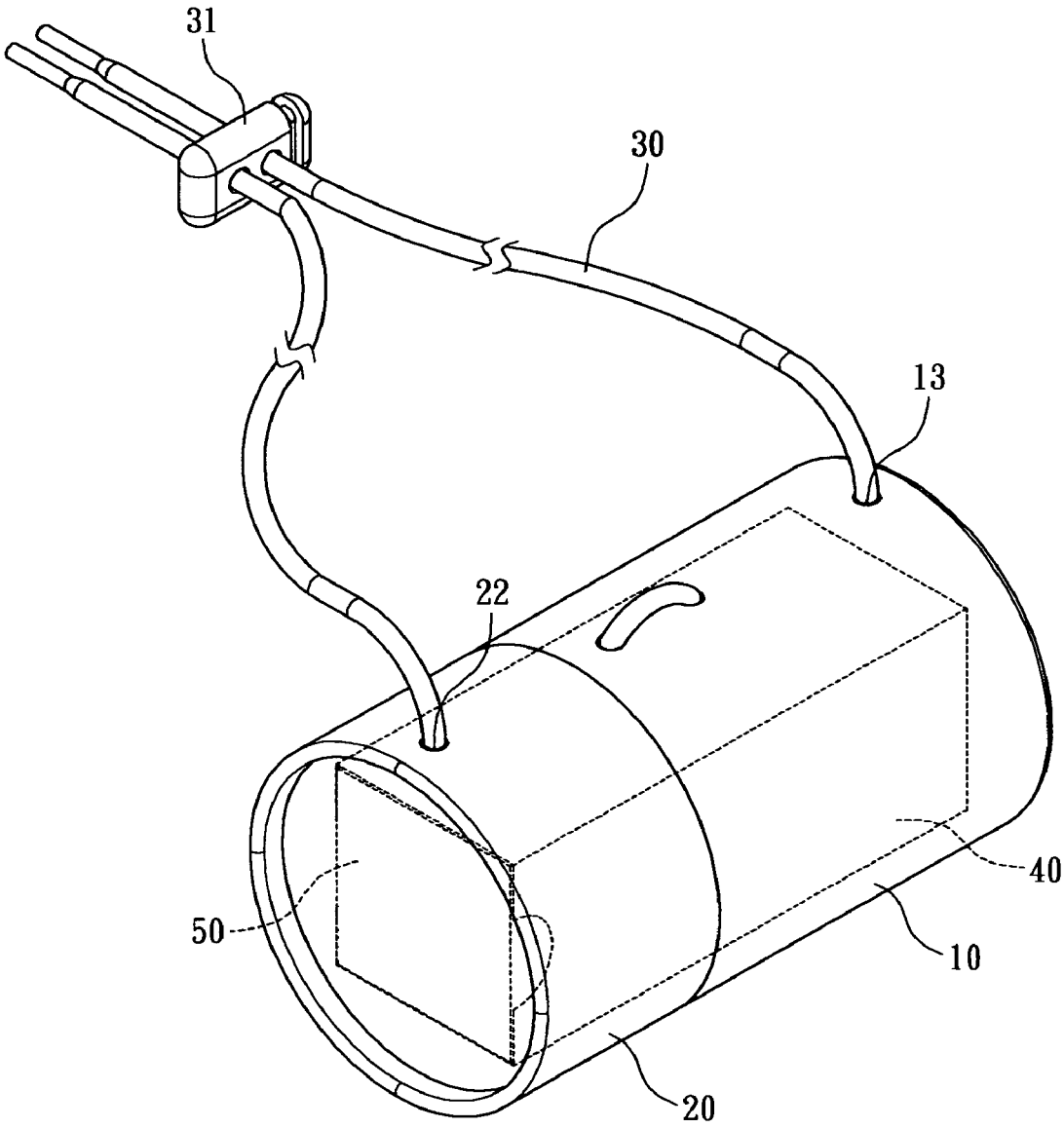
FIG. 2 is a perspective view of an excrement container of the present invention.
Figure 3:
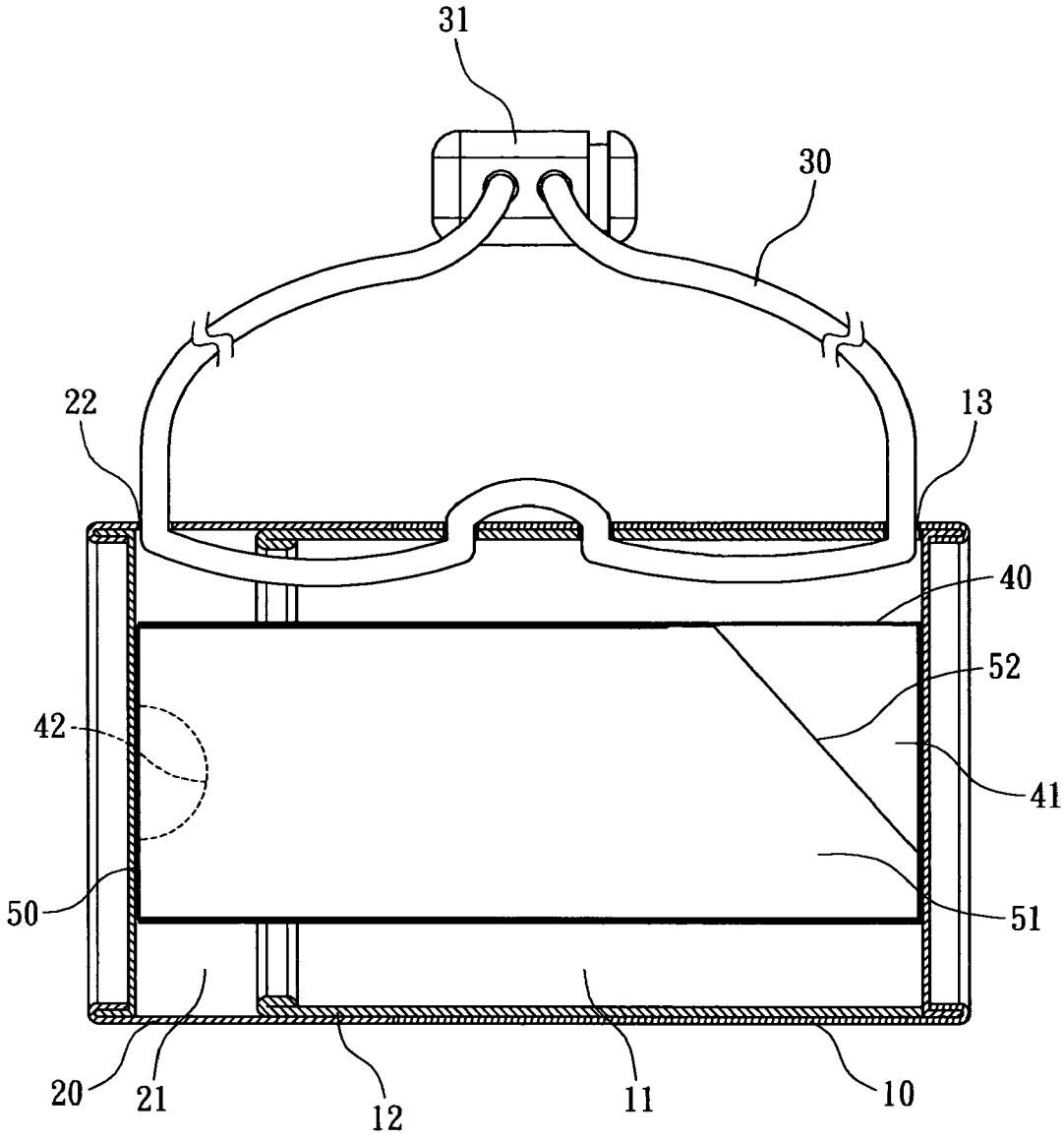
FIG. 3 is a sectional view of an excrement container of the present invention.

Referring to FIG. 1, FIG. 2 and FIG. 3, an explosive view, a perspective view and a sectional view of an excrement container of the present invention are respectively illustrated. The excrement container includes a box body 10, a cover body 20, a hanging member 30, a first inner cup 40 and a second inner cup 50.

The box body 10 is a hollow cylindrical body, which includes an opening 11 formed at one end thereof. A locking portion 12 is formed around the opening 11 in a stepped shape. A plurality of holes 13 is formed on the wall of the box body 10.

The cover body 20 includes an opening 21 formed on one end thereof. The opening 21 can be covered on the locking portion 12 of the box body 10, so as to form an encapsulated container. A hole 22 is formed on the wall of the cover body 20. One can adhere any kind of sticker or label on the other side of the cover body to provide information such as the name or phone number of the pet owner.

The hanging member 30 is made of cords or threads that can penetrate through the hole 13 of the box body 10 and the hole 22 of the cover body 20, so as to combine the box body 10 and the cover body 20. An adjustment member 31 is disposed on the hanging body 30 for adjusting the length of the hanging member 30, so as to properly hang the excrement container around the neck of any kind of pet.

The first inner cup 40 and the second inner cup 50 are made of paper and are both in box shape. The inner cups 40, 50 can be flattened into a thin flat sheet. The first inner cup 40 includes an opening 41 formed at one end thereof, wherein a pair of snips 42 is formed around the opening 41. The snips 42 can be in a semicircular shape, a U-shape, or other geometrical shapes. In this particular embodiment, the snips 42 are in a semicircular shape. The diagonals of the first inner cup 40 are smaller than the inner diameter of the box body 10, so as to contain the first inner cup 40 into the box body 10. On the other hand, the second inner cup 50 also includes an opening 51 formed on one end thereof. The opening 51 includes a inclination end 52. Each side of the second inner cup 50 is shorter than the corresponding side of the first inner cup 40, so as to insert the second inner cup 50 into the first inner cup 40.

In addition, the box body 10, the cover body, the first inner cup 40 and the second inner cup 50 of the excrement container of the present invention are all made of paper, and preferably the recycled paper.

Figure 4:
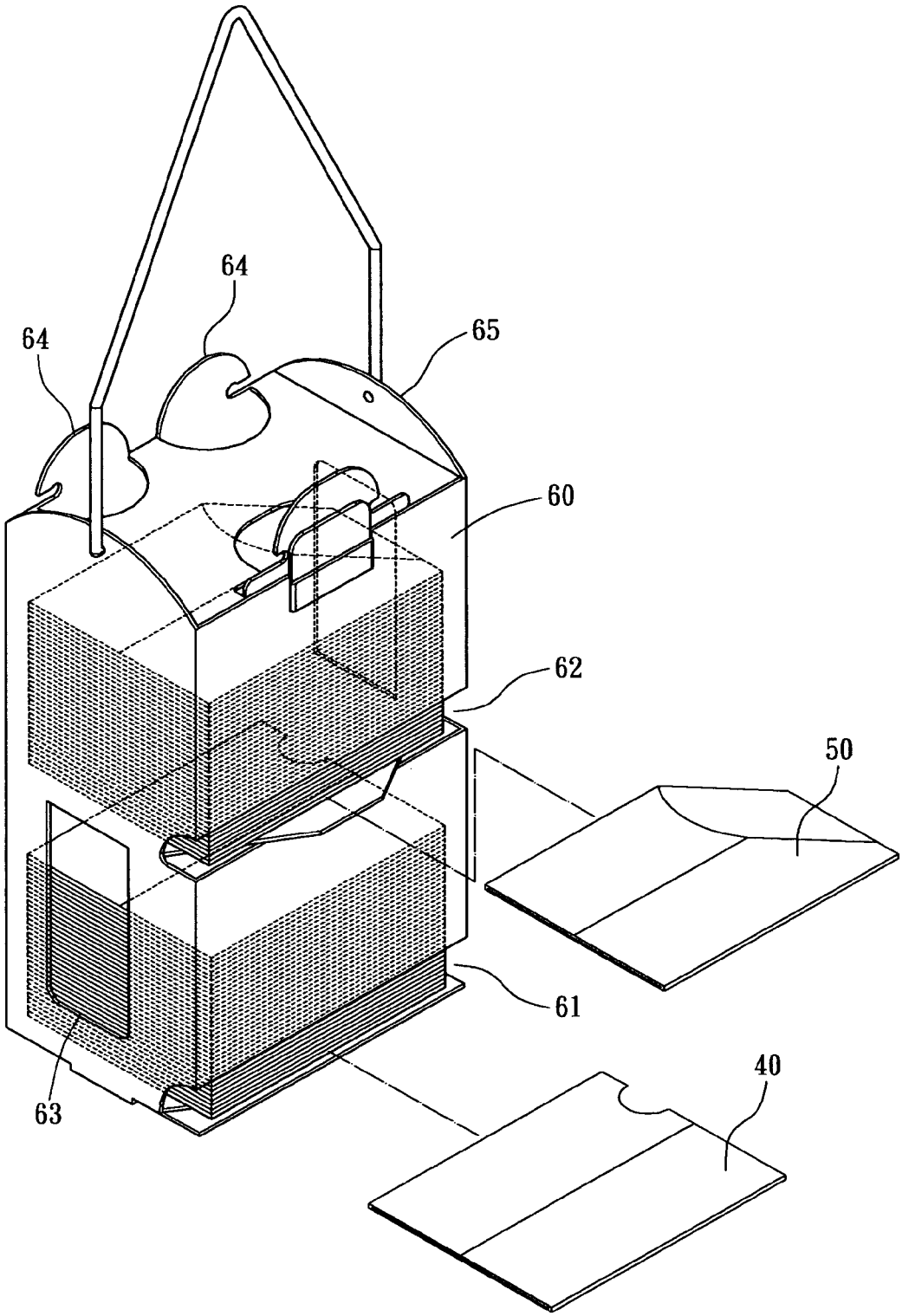
FIG. 4 illustrates in combination a collection box and a set of inner cups of the present invention.

Referring to FIG. 4, the combination of a collection box and a inner cups set is illustrated. The collection box 60 can contain a plurality of first inner cups 40 and a plurality of second inner cups 50. A first slot 61 and a second slot 62 are respectively formed on the bottom portion and the central portion of the collection box 60, thereby providing the first inner cups 40 and the second inner cups 50 to be abstracted therefrom. In addition, a transparent portion 63 is formed on two sides of the collection box 60 for inspecting the amount of inner cups 40, 50 still remained in the collection box 60. Moreover, a fastening portion 64 and a hanging portion 65 are formed at the top portion of the collection box 60. The fastening portion 64 is composed of a plurality of hanging ears formed in front of and behind the collection box 60. The hanging portion 65 can then be connected with a cord or a thread, so as to hang the collection box 60 onto a wall.

Figure 5:
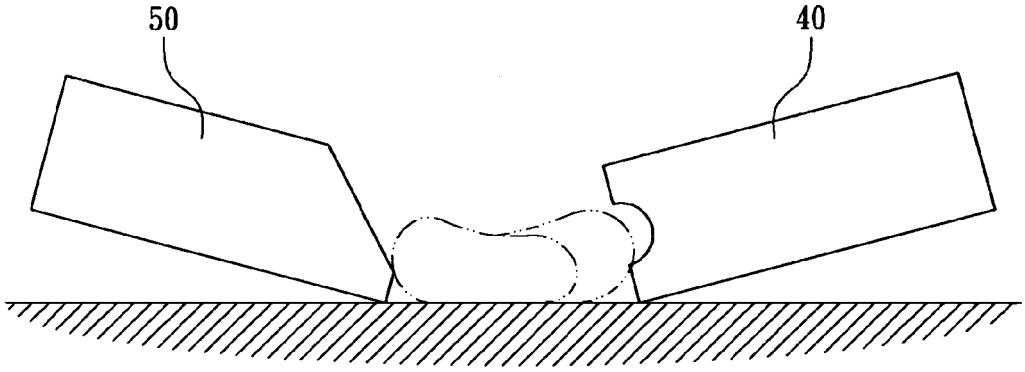
FIG. 5 illustrates how the inner cups of the preset invention are used.
Figure 6:
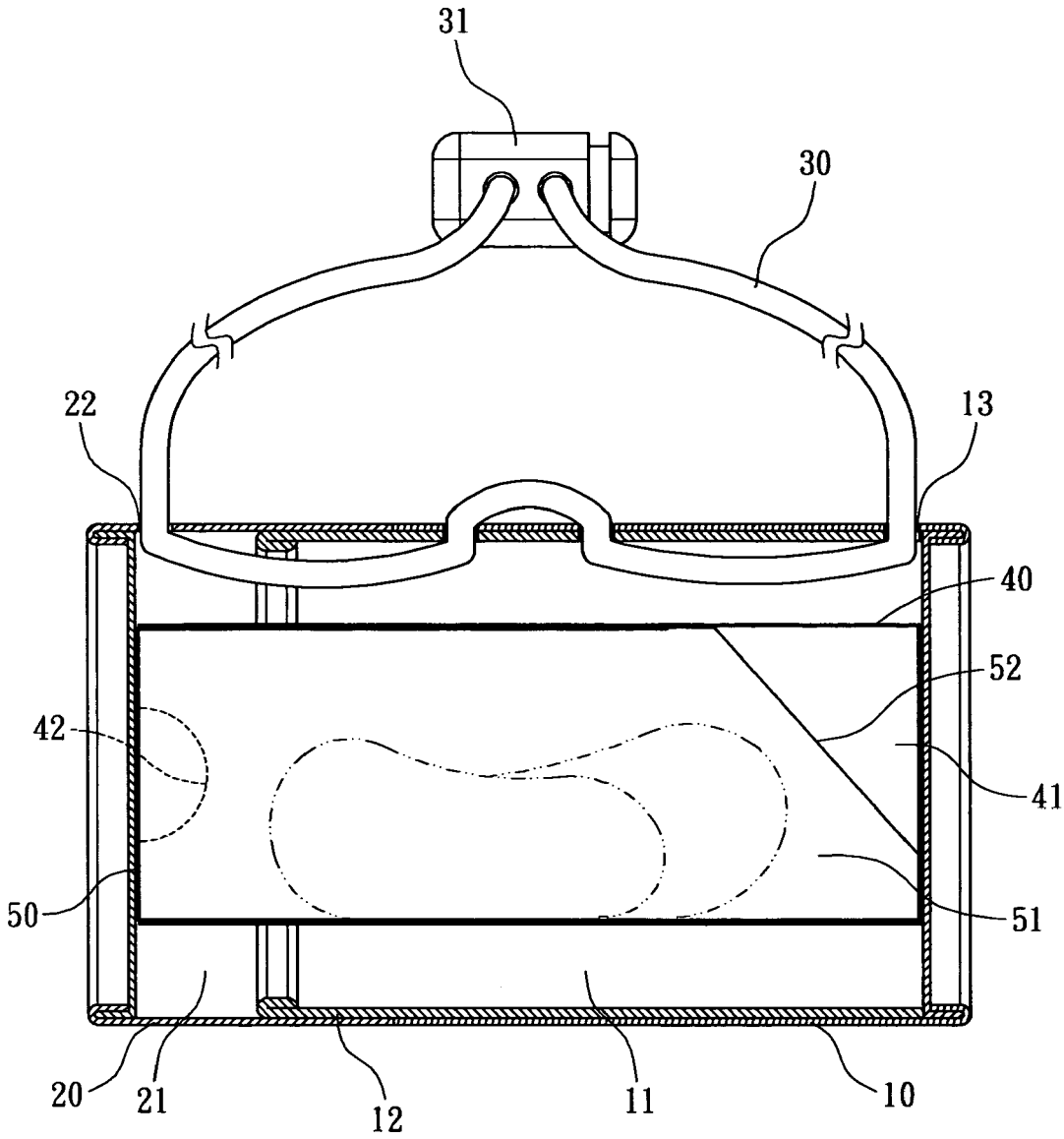
FIG. 6 illustrates how the excrement container of the present invention is used.

Referring, to FIG. 5 and FIG. 6, there are illustrated how the excrement container of the present invention is used. By using the hanging member 30, the excrement container of the present invention can be worn onto the neck of a pet. The pet can then bring the excrement container on its own. When the pet defecates, the pet owner can open the cover body 20 and take out the combination of the first inner cup 40 and the second inner cup 50. The second inner cup 50 can be taken out by pressing the two snips of the first inner cup 40. The opening 51 of the second inner cup 50 has a broad and smooth bottom rim, which can act as a dustpan for cleaning up the excrement. The second inner cup 50 can then be disposed again into the first inner cup 40, and into the box body 10. The cover body 20 then covers the opening 11 of the box body 10, so as to form an encapsulated container.

Figure 7:
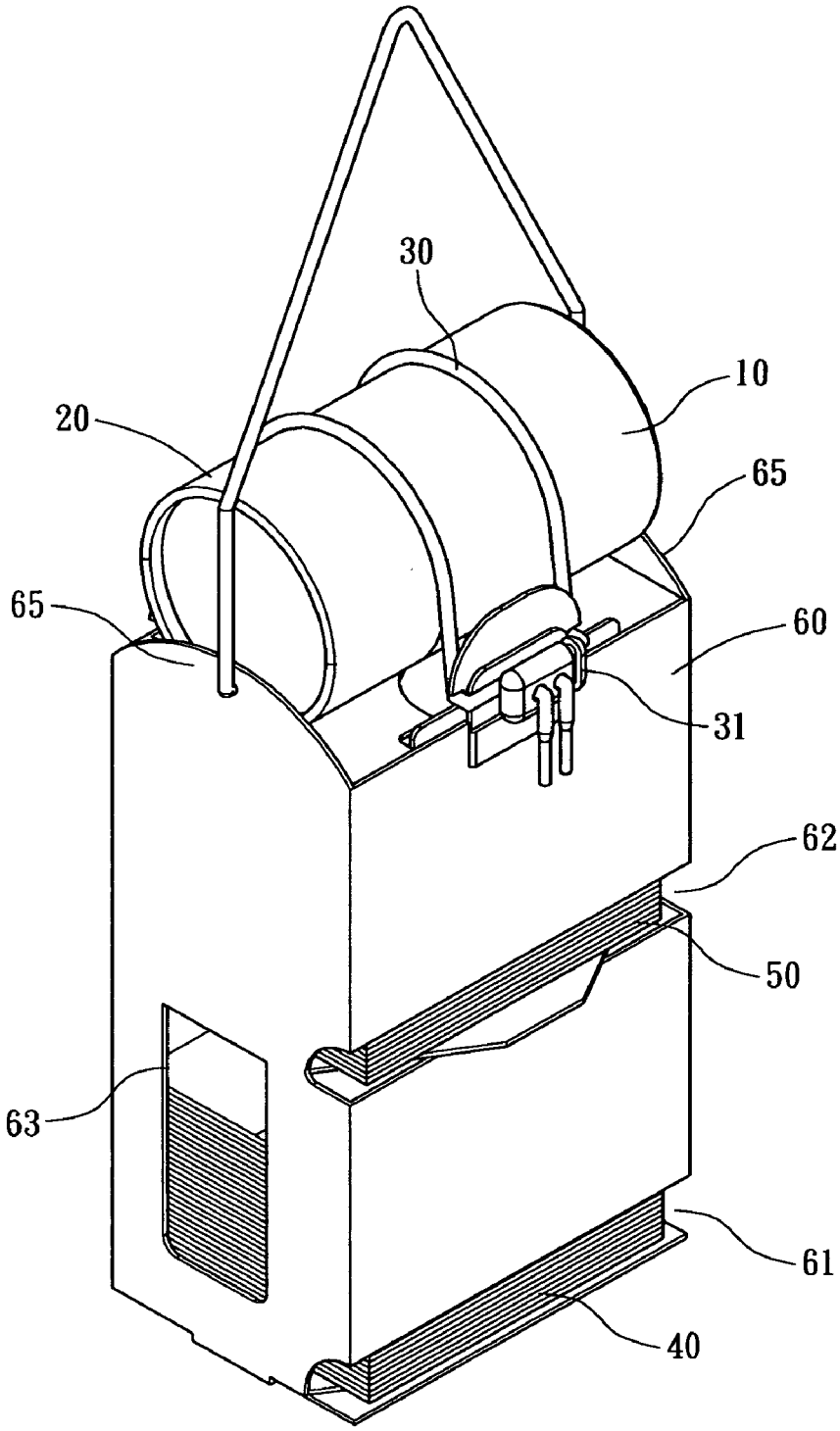
FIG. 7 illustrates in combination the collection box and the excrement container of the present invention.

Referring to FIG. 7, the combination of the excrement container and the collection box is illustrated. The excrement container of the present invention is disposed on the top surface of the collection box 60. Two ends of the hanging member 30 are respectively installed to the fastening portion 64, thereby forming a securely connected combination of the excrement container and the collection box 60.

In accordance with the detailed descriptions as set forth above, the excrement container of the present invention is advantageous in that:

1. The opening of the second inner cup includes a broad and smooth bottom rim and an inclination end that can ease the excrement cleaning up process.

2. The inner cups can be flattened into thin flat sheets, thereby reducing the storage space required and increasing the accessibility and portability thereof.

3. The inner cups are disposable, such that no cleaning and washing of the excrement container is necessary, thereby preventing the pet owner from contacting the excrement and getting infected of contagious diseases.

In summary, the excrement container of the present invention indeed contains patentable subject matter that is consistent with the utility, novelty and non-obviousness requirements as set forth in the patent law. Therefore, a grant of letters patent for the present invention is respectively requested.

Since, any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. An excrement container comprising:

a box body having an opening;

a first inner cup and a second inner cup contained in the box body, the second inner cup being disposed into the first inner cup, each inner cup being in a box shape, which can be flattened into a thin flat sheet;

a cover body covering on the opening;

a hanging body connecting the box body and the cover body; and a collection box providing a plurality of the first inner cups and a plurality of the second inner cups to dispose therein respectively and having a transparent portion on each two sides thereof.

2. The excrement container as recited in claim 1, wherein the box body, the cover body, the first inner cup and the second inner cup are made of paper.

3. The excrement container as recited in claim 2, wherein the paper comprises recycled paper.

4. The excrement container as recited in claim 1, wherein a plurality of holes are formed on the box body and the cover body for the hanging member penetrating through to connect the box body and the cover body.

5. The excrement container as recited in claim 1, wherein the opening of the box body comprises a locking portion for the cover body to combine with the box body.

6. The excrement container as recited in claim 1, wherein the hanging body comprises an adjustment member for adjusting a length thereof.

7. The excrement container as recited in claim 1, wherein the first inner cup comprises a pair of snips opposite to each other formed on the opening thereof.

8. The excrement container as recited in claim 1, wherein the second inner cup comprises an inclination end on the opening thereof .

9. The excrement container as recited in claim 1, wherein the second inner cup is smaller than the first inner cup to insert into the first inner cup.

10. The excrement container as recited in claim 1, wherein the collection box comprises a first slot and a second slot formed corresponding to the locations of the first inner cups and the second inner cups to be drawn therefrom.

11. The excrement container as recited in claim 10, wherein the collection box further comprises a fastening portion, the fastening portion providing the hanging body to be connected thereon, so as to securely dispose the box body and the cover body on the collection box thereby.

12. The excrement container as recited in claim 10, wherein the collection box further comprises a hanging portion for a cord connected therewith to hang the collection box on a wall.

13. An excrement container, comprising:

a box body having an opening;

a cover body covering on the opening of the box body;

a first inner cup including an inclination end;

a second inner cup including an opening that has two snips formed on the rim thereof; and a collection box providing a plurality of the first inner cups and a plurality of the second inner cups to dispose therein respectively, and having a transparent portion on each two sides thereof, wherein the second inner cup is inserted into the first inner cup, and both are disposed into the box body, and wherein each inner cup is in a box shape which can be flattened into a thin flat sheet.

14. The excrement container as recited in claim 13, further comprising a hanging member that is connected to the cover body and the box body for hanging the excrement container on the neck of a pet.

15. The excrement container as recited in claim 13, wherein the collection box comprises a first slot and a second slot formed corresponding to the locations of the first inner cups and the second inner cups to be drawn therefrom.

16. The excrement container as recited in claim 15, wherein the collection box further comprises a fastening portion, the fastening portion providing the hanging body to be connected thereon, so as to securely dispose the box body and the cover body on the collection box thereby.

17. The excrement container as recited in claim 15, wherein the collection box further comprises a hanging portion for a cord connected therewith to hang the collection box on a wall.

* * * * *